US008572884B1

(12) United States Patent
Saur

(10) Patent No.: US 8,572,884 B1
(45) Date of Patent: Nov. 5, 2013

(54) SURROGATE LOWER RECEIVER

(71) Applicant: Thomas W. Saur, Dearborn, MI (US)

(72) Inventor: Thomas W. Saur, Dearborn, MI (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/721,371

(22) Filed: Dec. 20, 2012

(51) Int. Cl.
*F41C 27/00* (2006.01)
*B25H 1/00* (2006.01)

(52) U.S. Cl.
USPC ..... 42/108; 269/909

(58) Field of Classification Search
USPC ..... 42/90, 108; 269/329, 909; 211/64
See application file for complete search history.

(56) References Cited

U.S. PATENT DOCUMENTS

| | | | | | |
|---|---|---|---|---|---|
| 4,548,392 | A * | 10/1985 | Rickling | ..... | 269/156 |
| 4,696,461 | A * | 9/1987 | Zelinski | ..... | 269/16 |
| 4,841,839 | A * | 6/1989 | Stuart | ..... | 89/37.04 |
| 5,580,474 | A * | 12/1996 | Smith | ..... | 219/137 R |
| 6,269,577 | B1 * | 8/2001 | Hardy | ..... | 42/90 |
| 7,406,794 | B1 * | 8/2008 | Pope, Jr. | ..... | 42/94 |
| 8,209,896 | B1 * | 7/2012 | Cashwell | ..... | 42/94 |

* cited by examiner

*Primary Examiner* — Bret Hayes
(74) *Attorney, Agent, or Firm* — Michael C. Sachs

(57) ABSTRACT

This surrogate lower receiver tool makes it possible to retract the slip ring element on a conventional M16/M4 family weapon when the hand guards must be removed or reinserted. As will be appreciated by those in the gun repair trade, in the disassembly or reassembly of such weapons the handling of the slip ring element is often a manually challenging and painstaking activity. This disclosed tool handily is an assist in such activities. The surrogate lower receiver tool makes it possible to remove and install hand guards without a lower receiver being installed on the firearm, thus avoiding the risk of damage to or loss of the lower receiver.

14 Claims, 8 Drawing Sheets

SURROGATE LOWER RECEIVER

U.S. GOVERNMENT INTEREST

The inventions described herein may be made, used, or licensed by or for the U.S. Government for U.S. Government purposes.

BACKGROUND AND SUMMARY OF INVENTION

This tool makes it possible to more conveniently handle the removal and installation of hand guards (forearms) on a conventional M16/M4 family weapon when the lower receiver subassembly is not available or not desired. As will be appreciated by those in the gun repair trade, in the disassembly or reassembly of such weapons the handling of the hand guards and allied elements is a challenging, tricky and painstaking activity often requiring two individuals, and a good deal of hand gripping strength combined with pulling strength, thus greatly needing improved assist. This disclosed tool handily is a great addition and assists in such activities.

The description as follows includes directional designations such as up, down, left, right, lateral, transverse, longitudinal, top, bottom, vertical, and the like, that are taken from the perspective of a firearm (e.g., a conventional AR-10/AR-15/M16 family, style, platform, or pattern rifle and M4 pattern carbine, and variants thereof) as typically held and operated by a user.

The description assumes the level of knowledge held by an ordinary armorer, gunsmith, repair or assembly technician, user, operator, maintenance personnel, and the like for a conventional AR-15/M16 pattern rifle and M4 pattern carbine, and variants thereof, and the respective components and operation thereof. The environment forms no part of the invention. Likewise, designations such as "a", "an", and "the" are not to be construed to be limited to a singular item or action unless apparent from the context or definitely described as such.

As used herein, elements having numbers more than 9 and less than 100 generally refer to conventional elements known in the art by one having ordinary skill, while elements number 100 and above refer to the present invention, or elements, components, and the like thereof.

Conventional elements include:

10: rifle, firearm, weapon, carbine, and the like; generally AR-10, AR-15/M16 rifle, M4 carbine;
12: upper receiver assembly;
14: lower receiver assembly;
16: hand guard (forearm, fore grip) group (assembly);
18: end cap;
20: slip ring, collar, delta ring;
22: hand guards;
30: front mounting lug of the upper receiver 12;
32: rear mounting lug of the upper receiver 12;
36: pivot pin—at front of the lower receiver 14;
38: take down pin—at rear of the lower receiver 14;
40: magazine well—at front of the lower receiver 14;
42: bolt carrier group—internal allied components of the lower receiver 14;
50: hand guard removal tool;
52L: left arm of the hand guard removal tool 50;
52R: right arm of the hand guard removal tool 50;
54: end plate of the hand guard removal tool 50; and
56: engagement flange of the hand guard removal tool 50.

As further understood by those having ordinary skill in the art, the conventional M16/M4/AR-15 family weapons are made to an exacting technical data description that is agreed upon by manufacturers and that provides interchangeability and modularity within and between manufacturers using such designation. As such, designation of the subject firearms as being within M16/M4/AR-15 family weapons provides the indication (designation) of de facto standardization of the components so designated. Thus, such designation is distinct and particular as used in connection with claims directed thereto.

During assembly and repair operations of AR-15/M16 pattern (style or family) rifles and M4 pattern (style or family) carbines (i.e., weapons), and variants thereof (referred to as guns, weapons, or firearms hereafter), the hand guards (i.e., mechanism, assembly, etc.) of such weapons, e.g., forearms, fore ends, hand grips, etc., as is well known to those skilled in the art of the assembly, maintenance, and repair of the weapons are often removed and installed (or reinstalled). Such repairs may include tasks such as but not limited to installation of new hand guards to replace damaged hand guards, upgrading of obsolete hand guards, and replacement of damaged gas tubes barrels, front sights, etc.

Referring to FIGS. 1 and 2, a left side elevation view of a conventional AR-15/M16 pattern rifle and/or M4 carbine 10 is illustrated; FIG. 2 is a broken partial view. Also referring to as well FIGS. 3(A-C), top, right side and rear elevation views, respectively, of a conventional hand guard removal tool 50 is illustrated. The firearm 10 comprises an upper receiver subassembly 12, and a lower receiver subassembly 14.

The upper receiver subassembly 12 comprises a hand guard group 16, and end cap 18, and a slip ring (e.g., delta ring, collar, etc.) 20. The hand guard group 16 comprises a pair of hand guards 22 that are configured to matingly engage the end cap 18 at the front, the slip ring 20 at the rear, and each other longitudinally to form a substantially solid structure that is urged and held (retained) in place via a slip ring spring (not shown). The details of the hand guard group 16 and allied components are well known to those of ordinary skill in the art. Further, details may be found, for example, in U.S. Pat. Nos. 3,090,150; 4,536,982; and 4,663,875, which are incorporated by reference in their entirety. One implementation of the slip ring spring may be found, for example, in U.S. Pat. No. 3,090,150 as element 28.

The upper receiver 12 further comprises a front mounting lug 30 and a rear mounting lug 32. The upper receiver 12 matingly engages the lower receiver subassembly 14 and the subassemblies 12 and 14 are held in place as a single unit via a pivot pin 36 at lateral holes in the front of the lower receiver 14 and through a hole in the front lug 30, and a takedown pin 38 at lateral holes in the rear of the lower receiver 14 and through a hole in the rear lug 32. The lower receiver 14 further comprises a magazine well 40 and a bolt carrier group 42. As is well known in the art, the magazine well 40 is configured to receive an ammunition magazine to feed cartridges into the weapon 10. During the conventional process of removal or installation of the hand guard assembly 16, the firearm bolt is retained within the upper receiver 12 by way of the lower receiver 14 and allied components.

In one example of conventional removal and/or installation of the hand guards 22, the conventional hand guard removal tool 50 generally includes a pair of lever arms 52L (left), and 52R (right), an end plate 54, and an engagement flange 56. The end plate 54 may be generally triangularly shaped having a first end of each of the arms 52L and 52R fixed outwardly from the plane of the triangle in the same generally perpendicular direction at two respective vertices and the engagement flange 56 fixed at the third vertex and protruding in the same direction as the arms 52L and 52R. When viewed from a side as shown, for example, on FIG. 3B, the conventional tool 50 has a generally hook ("J") shape.

The end plate 54 is sized such that the arms 52L and 52R are spaced to loosely intersect the outer perimeter of the slip ring 20 (shown in phantom on FIG. 3A, for reference) at about the fore-aft midpoint. The flange 56 is sized to loosely fit into the magazine well 40. The end plate 54 is further sized and shaped such that the arms 52L and 52R are substantially perpendicular to the main axis of the weapon 10. That is, the arms 52L and 52R are pointing away from the top side of the rifle 10 when the conventional tool 50 has the engagement flange 56 inserted into the magazine well 40 and the arms 52L and 52R are straddling the slip ring 20.

In some alternative conventional examples (not shown), the conventional hand guard installation and removal tool 50 is implemented as a single metallic rod that is bent into a shape similar to the conventional tool 50 as illustrated on FIGS. 3(A-C) and described herein. In another example of convention retraction of the slip ring 20, makeshift lever-type arrangements of paracord or rope wrapped around the slip ring 20 and threaded through the magazine well 40 of the lower receiver 14 similarly to the operation of the conventional tool 50. The methods of use of such alternative conventional examples are essentially the same as described herein in connection with the conventional tool 50 on FIGS. 1, 2, and 3(A-C).

With the conventional tool 50 mounted to (positioned on) the rifle 10 as described above, the operator squeezes the arms 52L and 52R towards each other (see, direction arrows, AS, on FIG. 3A) and substantially simultaneously forces the arms 52L and 52R rearward (see, direction arrow, AD, on FIGS. 1 and 3B) to compress the slip ring spring and slide (retract) the slip ring 20 rearward to release the hand guards 22 during removal and provide for insertion of the hand guards 22 during installation.

Another conventional example of a tool to aid the retraction of the slip ring 20 is shown and described in U.S. Pat. No. 6,269,577, issued to Hardy. U.S. Pat. No. 6,269,577 is directed to tool to assist in the field removal of a rifle's hand grips or hand guards, comprising a pair of releaseably joined split ring segments which are adapted to urge the slip ring of a rifle away from the rifle's mounting ring, thereby freeing the rifle's hand grips. Elastic means are provided linking the device with the rifle's stock thereby permitting pressure to continuously urge the slip ring away from the mounting ring.

However, while the tool of U.S. Pat. No. 6,269,577 does appear to provide a user a more firm grasp of the slip ring 20, the tool of U.S. Pat. No. 6,269,577 does not appear to provide the leverage gained via the arms 52L and 52R of the conventional tool 50. Further, the tool of U.S. Pat. No. 6,269,577 contains many small components that may be misplaced and, in any case, may cause a more time consuming operation than implementation of the conventional tool 50.

In another conventional method of installation and removal of the hand guards 22, no external tools are used. The operator, or sometimes multiple operators, manually grip and retract the slip ring 20 while simultaneously removing the hand guards 22 from the upper assembly 12. However, many hand guards 22 are too difficult to readily remove manually, even with the aid of a second person. As such, most users (owners, gunsmiths, armorers, repair technicians, etc.) perform AR-15/M16 pattern rifle and M4 pattern carbine hand guard installation and removal via the use of magazine well 40 of the lower receiver 14 of the rifle 10 and the conventional lever device 50 to retract the slip ring 20 as described above.

Currently used actual lower receivers 14 have the deficiencies that they are large and heavy (especially when a butt stock is installed), and expensive, subject to theft, may be damaged during the hand guard installation and removal process, and lower receivers 14 are a regulated article that is federally registered as a firearm. Many weapon owners, armorers and gunsmiths have multiple upper receiver assemblies 12 on which repair and maintenance are performed. The damage of a lower receiver 14 may be financially burdensome, and the loss of a lower receiver 14 may result in possible criminal investigation and/or prosecution.

Conventional devices and methods to retain the bolt carrier group 42 during handling and/or storage of the upper receiver 12 include securing the bolt carrier group 42 via tie wraps, cord, and the like, or with a commercially available AR-15/M16 Upper Receiver Bolt Saver apparatus from Black Dog Machine, LLC, Nampa, Id.

Thus, there is a need and a desire for a system and a process that overcomes one or more of the deficiencies of conventional devices and processes.

BRIEF DESCRIPTION OF THE INVENTION

The description herein assumes the level of knowledge held by an ordinary armorer, gunsmith, repair or assembly technician, user, operator, maintenance personnel, and the like for a conventional AR-15/M16 pattern rifle and M4 pattern carbine, and variants thereof, and the respective components and operation thereof. The description may include directional designations such as up, down, left, right, lateral, transverse, longitudinal, top, bottom, vertical, and the like, that are taken from the perspective of a firearm (e.g., a conventional AR-10/AR-15/M16 family, style, platform, or pattern rifle and M4 pattern carbine, and variants thereof) as typically held and operated by a user.

The surrogate lower receiver tool of the present invention eliminates the need for an actual lower receiver 14, thusly provides a non-regulated (i.e., not subject to government registration), compact, low cost, and light weight tool to aid the installation and removal of the hand guards of AR-15/M16 pattern rifle and M4 pattern carbine hand guards. The surrogate lower receiver tool is generally mounted on the upper receiver 12 in lieu of the lower receiver 14 to aid the removal and installation of the hand guards 22 (i.e., the subassembly 16).

The surrogate lower receiver of the present invention is implemented in connection with a conventional tool 50, and thusly eliminates the inconvenience and expense of a second person that is recommended when a single person is unable to manually perform the hand guard installation and removal processes, as is many times the case.

The surrogate lower receiver of the present invention may also be implemented as at least one embodiment that further provides retention of the firearm bolt carrier group. Such a bolt carrier group retention feature may reduce or eliminate possible damage or loss of the bolt carrier group during the hand guard installation and removal processes, or during storage of the upper receiver assembly 14.

DETAILED DESCRIPTION

Figure 1:
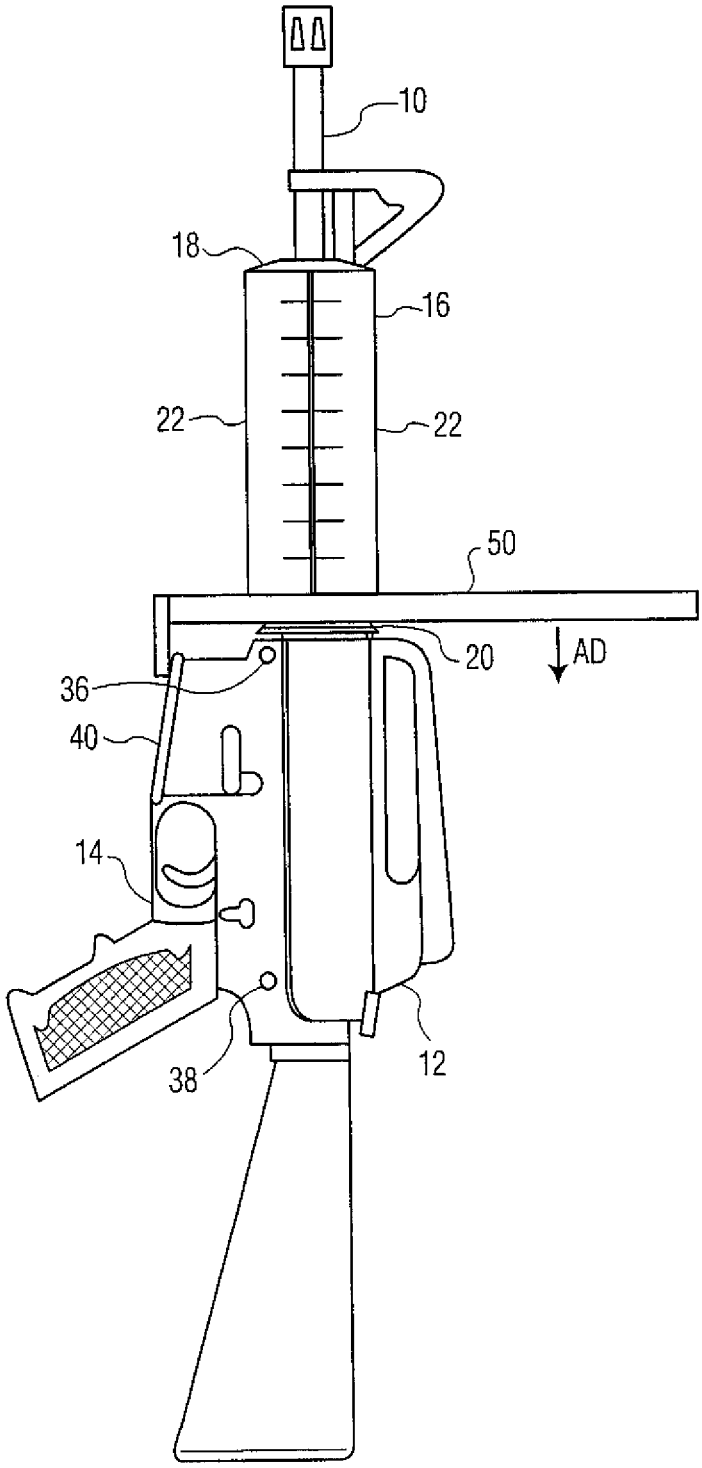
FIG. 1 (PRIOR ART)
FIG. 1 is a left side elevation view that illustrates a conventional, prior art AR-15/M16 rifle including the upper and lower receiver sections, and a conventional hand guard tool that is used in conventional removal and installation of the hand guards.
Figure 2:
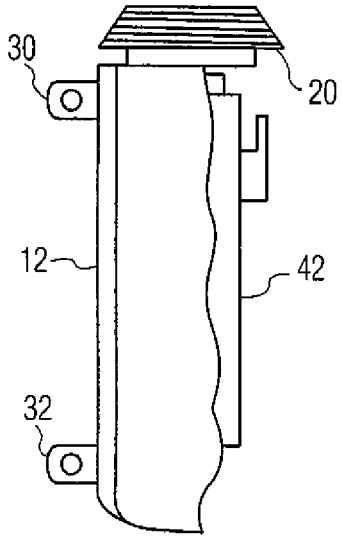
FIG. 2 (PRIOR ART)
FIG. 2 is a broken view of a portion of the left side the upper receiver of the firearm of FIG. 1.
Figure 3A:
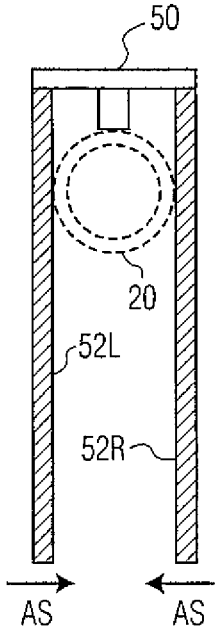
FIG. 3A (PRIOR ART)
FIGS. 3(A-C) are top, right side, and end views of the conventional hand guard tool of FIG. 1.
Figure 3B:
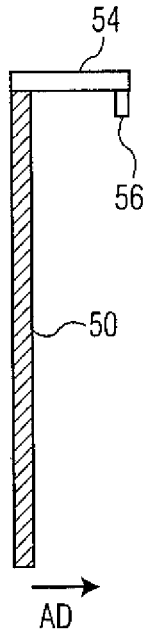
FIG. 3B (PRIOR ART)
Figure 3C:
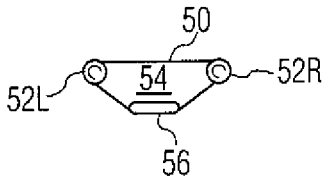
FIG. 3C (PRIOR ART)

FIGS. 1, 2, and 3(A-C), as described above, illustrate the conventional, prior art AR-15/M16 rifle and/or M4 carbine 10 that includes the conventional upper receiver 12 and the conventional lower receiver 14, and the use of a conventional hand guard removal and installation tool 50 during hand guard installation and removal.

The description as follows is directed to a firearm surrogate lower receiver tool 100 (wherein elements of the tool 100 are numbered 100 and above), and includes directional designations such as up, down, left (L), right (R), lateral, transverse, longitudinal, front, forward, back/backward/rearward, top, bottom, vertical, and the like, that are generally taken from the perspective of a firearm (gun, weapon, and the like, e.g., a conventional AR-10/AR-15/M16/M4 family, style, platform, or pattern rifle and carbine, and variants thereof as designated element 10 on FIG. 1 as typically held and operated (e.g., fired).

The description is generally related to and made in connection with the AR-15/M16 pattern (platform, style, or family) rifles and M4 pattern carbines (i.e., weapons), and variants thereof (referred to as guns, weapons or firearms hereafter). The description is generally applicable to removal and installation of the hand guard subassembly 16 (e.g., the hand guards 22), and the surrogate lower receiver tool 100 may be advantageously implemented in connection with other firearms having the same or similar hand guards. The surrogate lower receiver tool is generally mounted on the upper receiver 12 in lieu of the lower receiver 14 to aid the removal and installation of the hand guard subassembly 16. That is, the surrogate lower receiver tool generally mimics the performance of the conventional lower receiver 14.

Elements (numbered 100 and above) of the present invention may include but are not necessarily included in all embodiments and are not limited to:

100: surrogate lower receiver (tool, apparatus, device, assembly, kit, and the like);
102: mounting bar;
104: hook channel;
106: bolt retainer;
110: retaining pins (generally two);
120L, 120R: left and right, respectively, front retaining holes (in side portions of mounting bar 102);
122L, 122R: left and right, respectively, rear retaining holes (in side portions of mounting bar 102);
126L, 126R: left and right, respectively, front axis holes (in side portions of mounting bar 102);
128L, 128R: left and right, respectively, rear axis holes (in side portions of mounting bar 102);
130: front axis member (axle) (between the mounting bar 102 and the hook channel 104);
132: rear axis member (axle) (between the mounting bar 102 and the bolt retainer 106);
136: slot (in the mounting bar 102);
140: front spring;
142: rear spring;
150: stop edge (of the hook channel 104);
152: tang (tab, extension, and the like);
156: spacers (when implemented, generally two);
158L, 158R: laterally opposing left and right hook axle holes; and
160: axle retainer.

Figure 4:
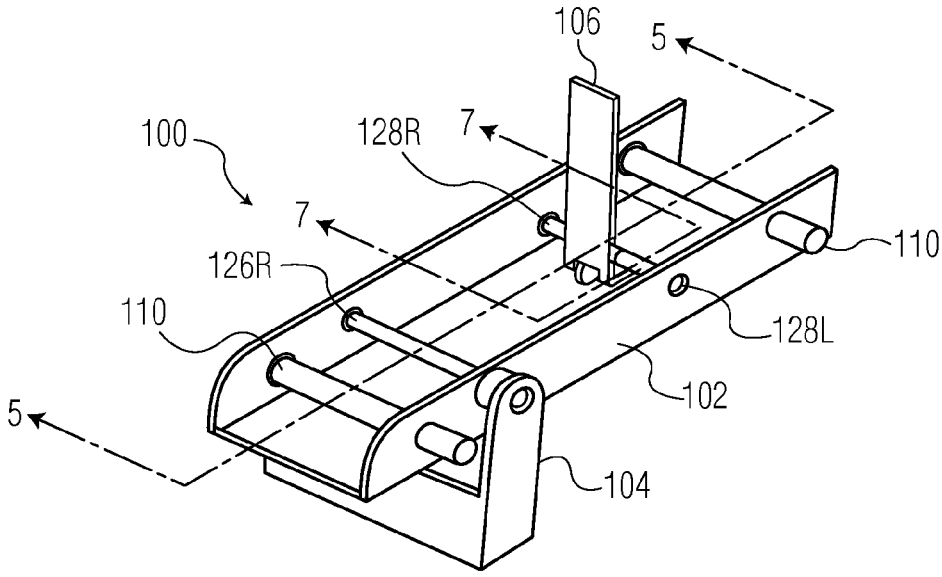
FIG. 4 is an isometric view from the front of a surrogate lower receiver tool of the present invention.

Referring to FIG. 4, an isometric view of a firearm hand guard removal and installation (or insertion) surrogate lower receiver tool (i.e., apparatus, device, unit, kit, assembly, etc.) 100 is shown from the front and left side. The tool 100 is generally implemented in connection with removal and installation of the hand guard group 16 of a conventional AR-15/M16 pattern rifle and/or M4 pattern carbine 10, and variants thereof (i.e., gun, firearm, weapon, etc.) having an upper receiver assembly (e.g., the receiver 12). On FIG. 4, the kit 100 is illustrated as generally oriented and deployed when installed on the upper receiver 12. For clarity of explanation, the upper receiver 12, the hand guard removal tool 50, and details of the spring loaded operation of the hook channel 104 and the bolt retainer 106 are not shown on FIG. 4. Refer also to FIGS. 5-11 for additional illustration and description.

The surrogate lower receiver 100 generally comprises a mounting bar 102, a hook channel 104, a bolt retainer 106, and a pair of mounting (fastening, retaining, holding, etc.) pins 110. The mounting bar 102 is generally implemented as a channel having two (e.g., left and right) vertical walls and a horizontal floor (e.g., bottom). The open channel portion of the mounting bar 102 is generally positioned upward when the surrogate lower receiver 100 is used. At opposing (i.e., front and rear) ends the mounting bar 102 further comprises pairs of lateral retention holes through the side walls of the channel and substantially across from each other (e.g., left and right front retention holes 120L and 120R, respectively; and left and right rear retention holes 122L and 122R, respectively). The hole 122L, a mirror of the hole 122R, while illustrated, is not labeled.

The channel member 102 generally has a width selected to provide a snug fit across the width of the front mounting lug 30 and the rear mounting lug 32 of the upper receiver 12. The longitudinal distance between the left front retention hole 120L and the left rear retention hole 122L, and likewise, the longitudinal distance between the right front retention hole 120R and the right rear retention hole 122R, are selected to be substantially the same as (e.g., match) the longitudinal distance between the lateral pivot pin mount hole in the front mounting lug 30 and the lateral take down pin hole in the rear mounting lug 32.

The diameters of the lateral hole through the front mounting lug 30, the left front retention hole 120L, and the right front retention hole 120R are substantially equal. The diameters of the lateral hole through the rear mounting lug 32, the left rear retention hole 122L, and the right rear retention hole 122R are substantially equal. The diameter of the retention pins 110 is selected to be slightly smaller than that of the pivot pin 36 and the take down pin 38 such that the retention pins 110 may easily and quickly slide in and out of the combination of the lateral hole through the front mounting lug 30, the left front retention hole 120L, and the right front retention hole 120R; and the combination of the lateral hole through the rear mounting lug 32, the left rear retention hole 122L, and the right rear retention hole 122R.

In a preferred embodiment, the retention pins 110 may be implemented as cinch pins which are known in the art and having a loop or circular stop on one end and ball-spring detent retention on the other end. When the retention pins 110 are implemented as cinch pins, one or more lanyards may be connected between the retention pins 110 and the mounting bar 102 to prevent or reduce the likelihood of loss of the retention pins 110.

In another example, the retention pins 110 may be implemented as bolts having a head and with an appropriate torque retention nut. In another example, the retention pins 110 may be implemented as unthreaded push pins having a head at one end and internal spring retention. When the retention pins 110 are implemented as unthreaded push pins, magnets (not shown) may be affixed on the outer surface of the mounting bar 102 proximate to the intended location of the heads of the retention pins 110 to provide or aid retention. In another example, the retention pins 110 may be implemented having circular grooves for retention via C clips. In another example, the retention pins 110 may be implemented having cross drilled holes for retention via hairpin clips. In other examples, the pins 110 may be implemented as push-pull, single, or double acting quick release pins.

The hook channel 104 is pivotally attached to the mounting bar 102 via a front axis member 130 that is laterally fastened via laterally opposing left and right front axis holes 126L (not shown, mirror of the right front axis hole 126R), and 126R, respectively, in the sides of the walls of bar 102; and laterally opposing left and right hook axle holes 158L (left, shown on FIG. 6) and 158R (right, not shown, mirror of the left hook axis hole 158L) in the hook channel 104 to form a lateral revolute (pivot) joint.

The bolt retainer 106 is pivotally attached to the mounting bar 102 via a rear axis member 132 that is laterally fastened via left and right, respectively, laterally opposing rear axis holes 128L and 128R in the sides of the walls of bar 102 and the bolt retainer 106 to form a lateral revolute (pivot) joint.

The hook channel 104 is generally pivotally biased against the outer surface of the bottom of the mounting bar 102 via a front spring 140. The bolt retainer 106 is generally pivotally biased against the inner surface of the bottom of the mounting bar 102 via a rear spring 142. The springs 140 and 142 may rotationally force the hook channel 104 and the bolt retainer 106, respectively, similarly to how a bail element on a mousetrap is forced by its spring.

The hook channel 104 is generally channel-shaped, having the open side inward spring biased against the mounting bar 102. The hook channel 104 comprises a stop edge 150 that is oriented laterally across the hook channel 104. When the hook channel 104 is unfolded (i.e., deployed, opened out, put into position for hand guard removal), the edge 150 generally rests against the outer surface of the bottom of the mounting bar 102 and prevents further rotational movement of the hook channel 104. When the hook channel 104 is unfolded, the angle between the mounting bar 102 and the hook channel 104 is generally at or slightly less than perpendicular to the rear. The hook channel 104 is otherwise biased by the front spring 140 about the front axis member 130 such that the bottom of the channel 104 rests against the bottom of the mounting bar 102, and the walls of the hook channel 104 are nested over the walls of the mounting bar 102.

Figure 5:
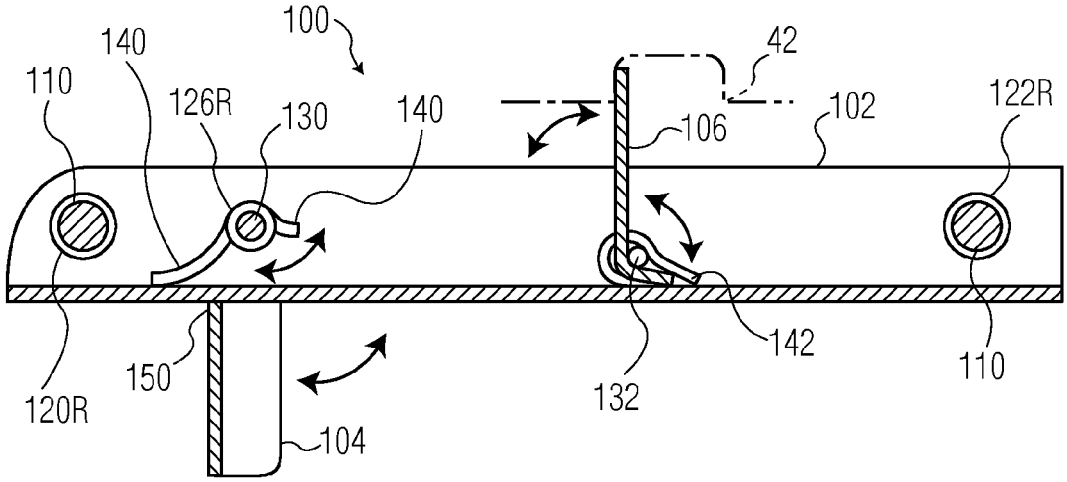
FIG. 5 is a sectional view of the surrogate lower receiver tool of FIG. 4.

On FIGS. 4 and 5, the surrogate lower receiver 100 is shown with the hook channel 104 and the bolt retainer 106 in deployed positions as would be the case when the tool 100 is installed on the upper receiver 12 and held in place via the mounting pins 110. However, when the surrogate lower receiver 102 is not installed on the upper receiver 12, the hook channel 104 is generally biased against the mounting bar 102 by the front bias spring 140 (see, for example FIG. 6 and related description).

The bolt retainer 106 is generally L-shaped, having a long leg of the L that is at an angle that is substantially perpendicular to the inner surface of the bottom of the mounting bar 102 when the bolt retainer 106 is deployed, and a short leg that rests against the inner surface of the floor of the mounting bar 102 and acts as a stop to prevent further (rearward) rotation of the bolt retainer 106. The length of the long leg of the bolt retainer 106 is selected to interface within the recess in the bolt carrier group 42 (as illustrated in phantom on FIG. 5) and thus retain (i.e., prevent reward movement of) the bolt carrier group 42.

Figure 7:
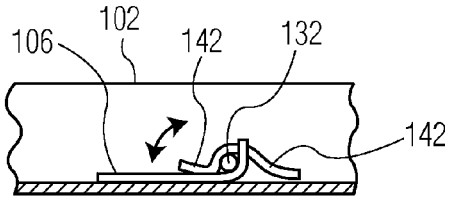
FIG. 7 is a sectional view that illustrates a bolt retainer component of the surrogate lower receiver tool of FIG. 4.

However, when the surrogate lower receiver 102 is not installed on the upper receiver 12, the long leg of the L of the bolt retainer 106 is generally biased against the floor of the mounting bar 102 by the rear bias spring 142 (see, FIGS. 7 and 11(A-D) and related descriptions).

Referring to FIG. 5, a sectional side view of the surrogate lower receiver 100 taken at the line 5-5 of FIG. 4 is shown. In one embodiment, the axis member 130 may be staked, welded, or otherwise firmly fixed to the hook channel 104 such that the axis member 130 and the hook channel 104 rotate as a single member. Likewise, the axis member 132 may be staked, welded, or otherwise firmly fixed to the bolt retainer 106 such that the axis member 132 and the bolt retainer 106 rotate as a single member.

The front spring 140 is generally implemented having a spiral shape and a first leg on the first end and a second leg on the second end. The inner surface of the spiral front spring 140 surrounds (wraps around) the front axis member (axle) 130. In one example, the front axis member 130 may be cross drilled to receive the first leg of the spring 140 and the second leg of the front bias spring 140 is positioned against the inner surface of the bottom of the bar 102 under tension such that the hook channel 104 is biased to and nested against the mounting bar 102 by the front bias spring 140.

The rear bias spring 142 is generally implemented having a spiral shape and a first leg on the first end and a second leg on the second end. The inner surface of the spiral rear spring 142 surrounds (wraps around) the rear axis member (axle) 132. In one example, the rear axis member 132 may be cross drilled to receive the first leg of the rear spring 142 and the second leg of the rear spring 142 is positioned against the inner surface of the bottom of the bar 102 under tension such that the long leg of the L of the retaining bolt 106 is biased against the mounting bar 102 by the rear bias spring 142.

In alternative embodiments where the legs of the springs 140 and 142 are positioned against the inner surface of the mounting bar 142 to provide rotational force to the hook channel 104 and the bolt retainer 106, the axes 130 and 132 are generally not cross drilled to receive a spring leg. In such embodiments, the axles 130 and 132 may include: (i) a bolt and nut subassembly, where the nut includes torque retention; (ii) a shaft with a head on one end and is grooved on the other end to receive a C-clip retainer; (iii) a shaft with a head on one end and on the other end is cross-drilled to receive a pin retainer (e.g., cotter pin, hairpin, and the like).

The fore-aft (longitudinal) position of the axle 130 (i.e., the left and right front axis holes 126L and 126R) is selected such that, when the hook channel 104 is deployed, the inner surface of the channel portion of the hook channel 104 is at substantially the same location as is the front of the magazine well 40 of the lower receiver 14.

The fore-aft (longitudinal) position of the axle 132 (i.e., the left and right rear axis holes 128L and 128R) is selected such that, when the bolt retainer 106 is deployed, the front surface of the long leg of the L shaped bolt retainer 106 is at substantially the same location as is the rear edge of a notch (recess) the bolt in the bolt carrier group 42 (shown in phantom) of the lower receiver 14. As such, the bolt retainer provides a definite stop that may prevent rearward, longitudinal movement of the bolt carrier group 42.

Figure 6:
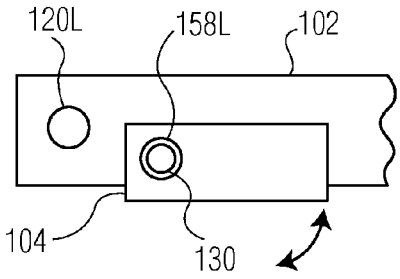
FIG. 6 is a broken left side view that provides more detail of a hook channel component of the surrogate lower receiver tool of FIG. 4.

Referring to FIG. 6, a partial left side view of the surrogate lower receiver 100 is shown. The hook channel 104 is illustrated in the closed (e.g., retracted down, folded, stowed, etc.) position as is the case when the hook channel 104 is biased against the mounting bar 102 by the front bias spring 140.

Referring to FIG. 7, a sectional side view of the surrogate lower receiver 100 taken at the line 7-7 of FIG. 4 is shown. However, contrary to the illustration of FIG. 4, the bolt retainer 106 is illustrated in the closed (e.g., retracted down, folded, stowed, etc.) position as is the case when the retaining bolt 106 is biased against the mounting bar 102 by the rear bias spring 142.

Figure 8A:
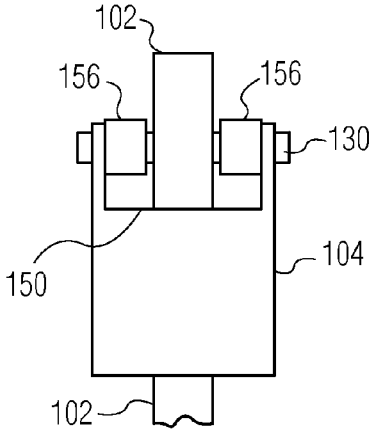
FIGS. 8(A-B) are partial bottom elevation views that illustrate two embodiments of the hook channel component of the surrogate lower receiver tool of FIG. 4.
Figure 8B:
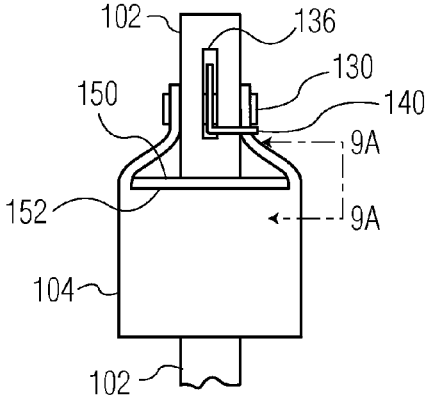

Referring to FIGS. 8(A-B), partial bottom views of the surrogate lower receiver 100 illustrating two alternative embodiments of the hook channel 104 are shown. In the embodiment shown on FIG. 8A, the hook channel 104 further comprises a pair of spacers 156. The spacers 156 are generally tubular (i.e., cylindrical with a through hole that receives the shaft 130). Leg portions of the hook channel 104 that receive the axis member 130 are substantially parallel to the main body of the hook channel 104 and are positioned away from the mounting bar 102 via the spacers 156 on the left and right sides of the axis member 130. In the embodiment shown on FIG. 8B, the leg portions of the hook channel 104 that receive the axis member 130 are bent inward to rest against the mounting bar 102 and receive the axis member 130. The spring 140 has a leg that extends through a slot 136 in the mounting bar 102 and is bent to urge the hook channel 104 against the mounting bar 102.

Figure 9:
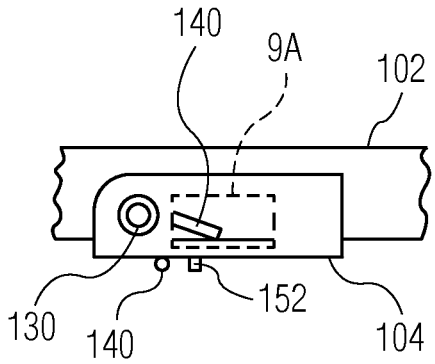
FIG. 9 is a left side elevation view of the hook channel component of the surrogate lower receiver tool of FIG. 8B, also illustrated as inset 9A is an illustration of a spring component of the surrogate lower receiver tool of FIG. 4.

Referring to FIG. 9, including sectional view 9A taken at line 9A-9A on FIG. 8B, a left side view of the hook channel 104 is shown. Referring back to FIG. 8B, as well as FIG. 9, in another example embodiment, the lateral stop edge 150 may further include a laterally oriented tang (e.g., tab, extension, protrusion, etc.) 152. The tang 152 may extend from the bottom of the hook channel 104 and may provide strength and stability to the interface of the hook channel 104 and the mounting bar 102 when the hook channel is opened for use during hand guard removal or installation. Sectional view 9A more clearly illustrates a leg of the spring 140 at rest on the inner surface of the bottom portion of the channel bar 102.

Figure 10:
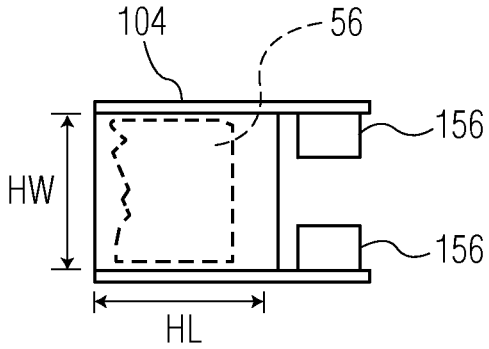
FIG. 10 is a top elevation view of the hook channel component of the surrogate lower receiver tool of FIG. 8A.
Figure 11A:
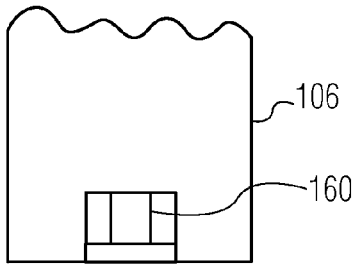
FIGS. 11(A-D) are rear partial, left side partial, front partial, and top elevation views of the bolt retainer component of the surrogate lower receiver tool of FIG. 4.
Figure 11B:
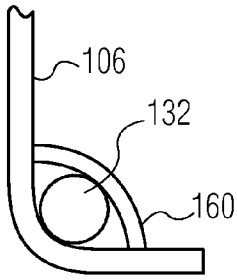
Figure 11C:
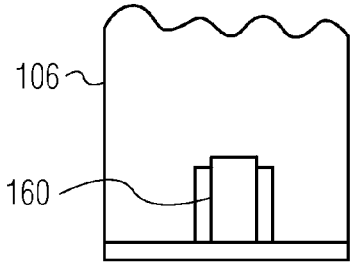
Figure 11D:
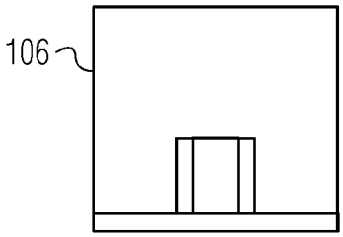

Referring to FIG. 10, a top view of the embodiment of the hook channel 104 as illustrated on FIG. 8A, is shown. The channel body of the hook channel 104 generally has a width, HW, and a length, HL, that are sized to loosely but securely receive the engagement flange 56 (illustrated for reference in phantom) to provide firm purchase (i.e., solid resting position) during use of the surrogate lower receiver 100 (as described below in connection with FIG. 12).

Referring to FIGS. 11(A-D), back (rear) partial, left side partial, front partial, and top views, respectively, of the bolt retainer 106 are shown. For clarity, the axle 132 is only illustrated on FIG. 11B. As previously described, the bolt retainer 106 is generally L-shaped, having the long leg of the L that is spring biased via the rear spring 142 against the mounting bar 102 when the surrogate lower receiver 102 is not in use to retain the bolt carrier group 42, and a short leg that rests against the mounting bar 102 when the surrogate lower receiver 102 is implemented to retain the bolt carrier group 42. The bolt retainer 106 further comprises an axle retainer 160 that is formed at the right angle of the L. In another example, the axle retainer 160 may be implemented as a tubular element. The axis member (axle) 132 is generally laterally positioned through the axle retainer 160 and the walls of the mounting bar 102.

Gaps between the axle retainer 160 and the body of the bolt retainer 106 are sized to accommodate the legs of the rear spring 142.

When the bolt retainer 106 is unfolded (i.e., deployed, opened out, put into position for hand guard removal), the long leg of the L generally rests against the rear surface the bolt component near the firing pin within a recess of the bolt carrier group 42 (see, FIG. 5). However, when the bolt carrier group 42 is not present in the upper receiver 12, the bolt retainer 106 is left in the undeployed position. When the bolt retainer 106 is unfolded, the angle between the long leg of the L and the inner surface of the bottom of the mounting bar 102 is generally at or slightly less than perpendicular. The bolt retainer 106 is otherwise biased by the front spring 142 about the rear axis member 132 such that the long leg of the L rests against the bottom of the mounting bar 102.

As is known to one of skill in the art, a number of appropriate arrangements may be implemented to bias the hook channel 104 against the mounting bar 102 and the bolt retainer 106 against the mounting bar 102; i.e., provide rotational tension (torque) about an axis between two elements on an axis, as well as the embodiments described. The legs (i.e., arms, extensions, prongs, etc.) of the bias springs 140 and 142 are generally positioned such that the hook channel 104 and the bolt retainer 106 are biased (i.e., urged, forced, pushed, actuated, etc.) against the mounting bar 102, that is, to closed (retracted) positions to provide a compact, easy to store device.

The mounting bar 102, the hook channel 104, and the bolt retainer 106 may be made from metal (e.g., steel, aluminum, or the like), filled plastic (e.g., nylon, polymer), high strength polymer, composites, or any other material having the requisite materials properties as would be known to one of skill in the art. The pins 110 and the springs 140 and 142 are generally made of steel or steel alloy.

Figure 12:
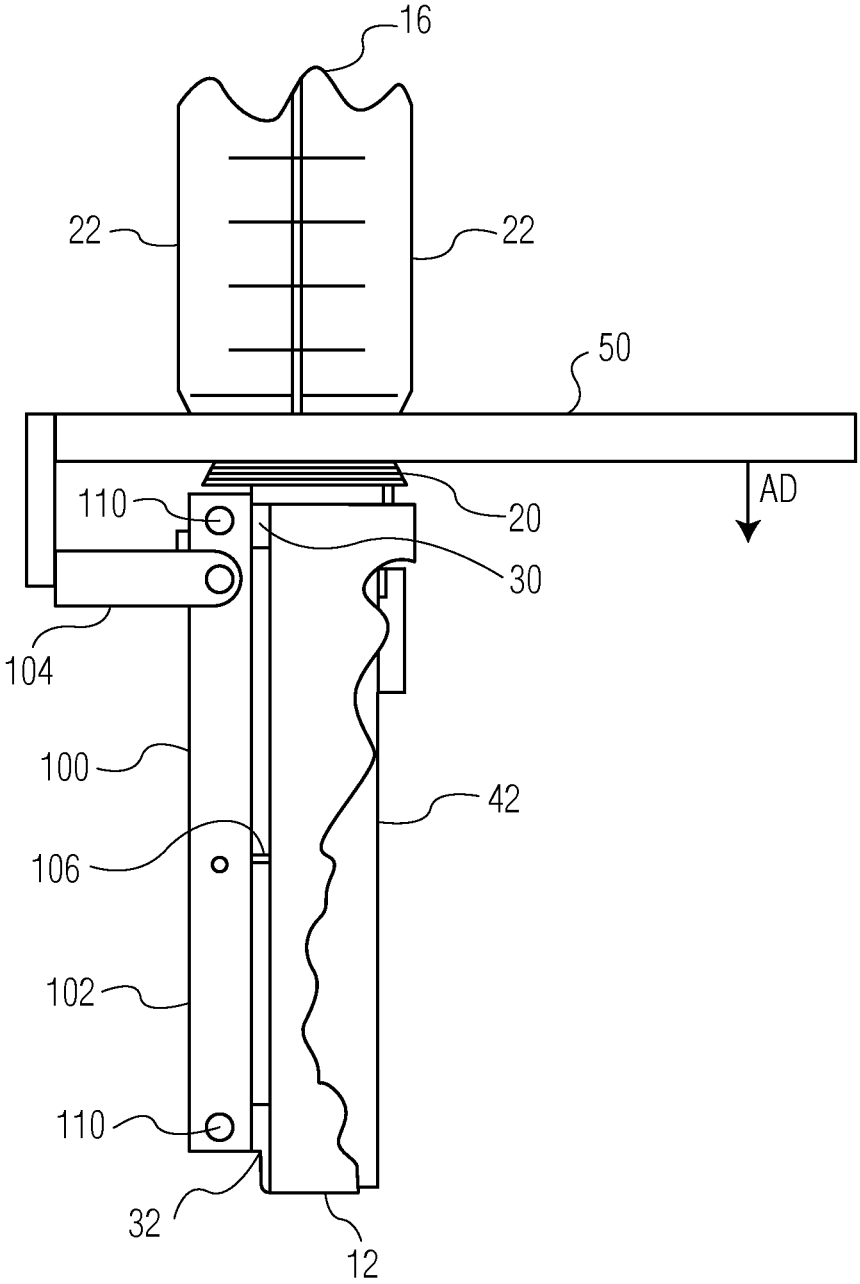
FIG. 12 is a broken view of the left side of the firearm upper receiver illustrating the mounting of the tool of FIG. 4 during the hand guard installation and/or removal process.

Referring to FIG. 12, a partial left side view illustrating use of the surrogate lower receiver tool 100 is illustrated in connection with the conventional upper receiver 12 and the conventional hand guard tool 50 is shown. To mount the surrogate lower receiver 100 to the upper receiver 12 when the bolt carrier group 42 is installed, the bolt retainer 106 is rotated to the vertical position. This step is not implemented when the bolt carrier group 42 is not present. The surrogate lower receiver 100 is aligned at the lugs 30 and 32 with the hook channel 104 at the front, at the front, one of the pins 110 is generally inserted laterally through a hole 120L or 120R, and through the hole in the lug 30 and across the mounting bar 102. Similarly, at the rear one of the pins 110 is generally inserted laterally through the hole 122L or 122R, and through the hole in the lug 32 and across the mounting bar 102. The order of insertion of the pins 110 can be either front-rear or rear-front. As such, the surrogate lower receiver 100 is matingly engaged to the upper receiver 12.

The hook channel 104 is then deployed to a position substantially perpendicular to the main axis of the upper receiver 12, the hand guard tool 50 is positioned with the legs 52 straddling the slip ring 20, and the engagement flange 56 is inserted into the channel of the hook channel 104. As is done when a conventional lower receiver 14 is installed on the upper receiver 12, the legs 52 of the hand guard tool 50 are squeezed together and pushed rearward to retract the slip ring 20. When removal or installation of the hand guard group 16 is complete, the pins 110 are pulled free and the surrogate lower receiver 100 is removed from the upper receiver 12. However, when desired, the surrogate lower receiver 100 may be left installed on the upper receiver 12 such that the upper receiver may be stored, handled, shipped, and the like with the bolt carrier group 42 securely held in place via the bolt retainer 106 of the surrogate lower receiver 100.

A number of simplified alternative embodiments of the tool 100 may be implemented. For example, at the joints between the bar 102 and the hook channel 104, the spring 140 may be deleted and the rotational position of the hook channel 104 may be maintained via friction, ribs, dimples, surface roughness, striations, and the like at the interface between the bar 102 and the hook channel 104. Similarly, the spring 142 may be deleted and the bolt retainer 106 may be held in position via frictional fit of the bolt retainer 106 to the mounting bar 102.

In another embodiment, when the need for retention of the bolt carrier group 42 is not anticipated by the user, the bolt retainer 106 and the spring 142 may be deleted.

The firearm tool 100 is generally used by a user such as an armorer, gunsmith, repair or assembly technician, maintenance personnel, and the like. However, a home (non-commercial) user may find the surrogate lower receiver tool 100 to be a useful aid as well. The surrogate lower receiver 100 generally mimics a lower receiver 14 and, in connection with the conventional hand guard removal tool 50, provides an improved system and method of retracting the slip ring 20.

While the invention may have been described with reference to certain embodiments, numerous changes, alterations and modifications to the described embodiments are possible without departing from the spirit and scope of the invention as defined in the appended claims, and equivalents thereof.

The invention claimed is:

1. A surrogate lower receiver for a rifle for use during removal and installation of hand guards on the rifle using a hand guard removal tool, the rifle having an upper receiver that includes a retractable slip ring, a front lug having a lateral pivot pin hole, and a rear lug having a lateral take down pin hole, and the hand guard removal tool having an engagement flange, the surrogate lower receiver comprising:

a mounting bar that is channel shaped with the channel having left and right walls that are spaced apart to fit the front lug and the rear lug, and a bottom, the mounting bar walls further comprising (i) laterally opposing left and right front retainer holes and laterally opposing left and right rear retainer holes, wherein the left and right front retainer holes and the left and right rear retainer holes are longitudinally spaced to match the distance between the pivot pin hole and the take down pin hole, and (ii) laterally opposing left and right front axis holes; and a hook channel having laterally opposing left and right hook axle holes and a lateral stop edge;

a pair of retainer pins, wherein the hook channel is pivotally attached to the mounting bar via a front axis member that is laterally positioned in the left and right walls of the mounting bar through the left and right front axis holes and the left and right hook axle holes to form a lateral revolute joint such that in a closed position the hook channel is nested against the bottom of the mounting bar and in a deployed position the hook channel is rested by the stop edge substantially perpendicular to the bottom of the mounting bar and away from the upper receiver, and during use to retract the slip ring, the mounting bar is attached to the upper receiver via a first of the retainer pins laterally positioned through the left and right front retainer holes and the pivot pin hole and a second of the retainer pins laterally positioned through the left and right rear retainer holes and the take down pinhole, the hook channel is rotated to the deployed position, and the engagement flange is engaged in the hook channel such that the slip ring is retracted.

2. The surrogate lower receiver of claim 1 wherein, the surrogate lower receiver further comprises (1) a rear axis member, and (ii) a bolt retainer having an axle retainer;

the bolt carrier group further includes a recess and a bolt; and the mounting bar further comprises laterally opposing left and right front axis holes, wherein the bolt retainer comprises an L shaped member that is pivotally attached inside the mounting bar via the rear axis member that is laterally positioned in the left and right walls of the mounting bar through the left and right rear axis holes and the axle retainer to form a lateral revolute joint such that in a closed position the long leg of the L shape of the bolt retainer is against the bottom of the mounting bar and the short leg of the L shape is substantially perpendicular to the bottom of the mounting bar, and in a deployed position the long leg of the L shape of the bolt retainer is substantially perpendicular to the bottom of the mounting bar and towards the upper receiver and the short leg of the L shape is against the inside of the bottom of the mounting bar.

3. The surrogate lower receiver of claim 2 further comprising a front spring and a rear spring, wherein the front spring is configured to urge the hook channel to the closed position and the rear spring is configured to urge the bolt retainer to the closed position; and during use, prior to attaching the mounting bar to the upper receiver a user moves the hook channel and the bolt retainer to the deployed positions, and inserts the bolt retainer into the recess in the bolt carrier to retain the bolt.

4. The surrogate lower receiver of claim 3, wherein the front spring and a rear spring comprise spiral springs, the front spring surrounds the front axis member, and the rear spring surrounds the rear axis member.

5. The surrogate lower receiver of claim 3, wherein when not in use, the retaining pins are attached to the mounting bar by one of magnets and a lanyard.

6. The surrogate lower receiver of claim 3, wherein the mounting bar, the hook channel, and the bolt retainer are made from one of metal, filled plastic, high strength polymer, and composites.

7. The surrogate lower receiver of claim 3, wherein the retaining pins, the front and rear axis members, and the front and rear springs are made of steel or steel alloy.

8. The surrogate lower receiver of claim 2 wherein, the bolt retainer is maintained in position by friction between the mounting bar and the bolt retainer.

9. The surrogate lower receiver of claim 2 wherein, the front and rear axis members are implemented as at least one of a cinch pin, a bolt and nut combination end where the nut has a torque retention feature, and a bolt having a head on one end and a groove that is configured to accept a C-clip on the other end.

10. The surrogate lower receiver of claim 1, wherein the hook channel stop edge further comprises a tang.

11. The surrogate lower receiver of claim 1, wherein the hook channel is maintained in position by friction between the mounting bar and the hook channel.

12. The surrogate lower receiver of claim 1 wherein, the retaining pins are implemented as at least one of a cinch pin, a bolt and nut combination, and a bolt having a head on one end and a groove that is configured to accept a C-clip on the other end.

13. The surrogate lower receiver of claim 1 wherein, the hand guard removal tool is a conventional hand guard removal tool that further comprises left and right lever arms and an end plate; and the end plate is triangularly shaped having a first end of each of the left and right lever fixed outwardly from the plane of the triangle in the same generally perpendicular direction at two respective vertices and the engagement flange is fixed at the third vertex and protruding in the same direction as the left and right lever arms such that the hand guard removal tool has a hook (J) shape; and during use, the left and right lever arms straddle the slip ring and are squeezed together and rearward substantially simultaneously by a user.

14. The surrogate lower receiver of claim 1, wherein the rifle referred to is one of: a conventional AR-10, a conventional AR-15, a conventional M16, a conventional M4 carbine, an M16 family, style, platform or pattern rifle, or an M4 carbine variant rifle.

* * * * *